US007665189B2

(12) United States Patent
Nelson et al.

(10) Patent No.: US 7,665,189 B2
(45) **Date of Patent: *Feb. 23, 2010**

(54) CLOTHES FASTENING SYSTEM

(76) Inventors: Sherlon Arleigh Nelson, 6 Tanglewood Pl. East, Monroe Township, NJ (US) 08831; Sherwin Arlon Nelson, 6 Tanglewood Pl. East, Monroe Township, NJ (US) 08831; Neville Adolphus Nelson, 6 Tanglewood Pl. East, Monroe Township, NJ (US) 08831

( * ) Notice: Subject to any disclaimer, the term of this patent is extended or adjusted under 35 U.S.C. 154(b) by 0 days.

This patent is subject to a terminal disclaimer.

(21) Appl. No.: 11/358,678

(22) Filed: Feb. 21, 2006

(65) Prior Publication Data

US 2006/0137146 A1 Jun. 29, 2006

Related U.S. Application Data

(63) Continuation-in-part of application No. 10/410,034, filed on Apr. 8, 2003, now Pat. No. 7,032,275.

(51) Int. Cl.
*A41F 17/04* (2006.01)

(52) U.S. Cl. ..... 24/72.1; 2/232; 2/309; 2/311

(58) Field of Classification Search ..... None
See application file for complete search history.

(56) References Cited

U.S. PATENT DOCUMENTS

| | | | | | |
|---|---|---|---|---|---|
| 251,257 | A | * | 12/1881 | Ligabue | 2/232 |
| 295,091 | A | * | 3/1884 | Alexander | 24/41.1 |
| 386,345 | A | * | 7/1888 | Pickhardt | 24/41.1 |
| 392,676 | A | * | 11/1888 | Jacoby | 2/52 |
| 397,704 | A | * | 2/1889 | Diamond | 36/70 R |
| 405,761 | A | * | 6/1889 | Bevinger | 2/309 |
| 416,477 | A | * | 12/1889 | Mahiat | 2/223 |
| 561,576 | A | * | 6/1896 | Flannery | 2/302 |
| 2,615,171 | A | * | 10/1952 | Borowick | 2/308 |
| 3,137,863 | A | * | 6/1964 | Dimpfl | 2/232 |
| 4,825,475 | A | * | 5/1989 | Smart | 2/312 |

* cited by examiner

*Primary Examiner*—Jack W. Lavinder

(57) ABSTRACT

A clothes fastening system comprising an attachment member configured for attachment to a wearer's footwear where such attachment member has a first fastener attached thereto. A fastening mechanism is attached to the wearer's clothing where such fastening mechanism has a second fastener attached thereto. The first and second fasteners are detachably attached to each other thus preventing at least a portion of the wearer's clothing from dragging against the ground while the wearer is walking.

6 Claims, 14 Drawing Sheets

CLOTHES FASTENING SYSTEM

This application is a continuation in part of prior application Ser. No. 10/410,034, filed Apr. 4, 2003, now U.S. Pat. No. 7,032,275

BACKGROUND OF THE INVENTION

1. Field of the Invention

The present invention relates to a fastening system for fastening clothing to footwear.

2. Description of the Related Art

Clothing styles change with the times. Currently, many individuals prefer loose fitting and even oversized clothing. In particular, many persons wear pants several sizes larger than their proper size. Also, sometimes even though a pair of pants or other clothing may be the proper size, a part of such clothing may not fit correctly. Regardless of whether or not a person intentionally wears oversized clothing, the loosely fitting or oversized parts of the clothing that cover a person's limbs (e.g., arms, legs) often have to interface and/or engage with footwear or hand wear. For example, the legs of an oversized pants may hang over a wearer's shoes and heels to such an extent that part of the legs drags against the ground as the wearer is walking resulting in frayed ends. Also during inclement weather (e.g., rain, snow) the overhanging portion of the pants' legs is dragged along the wet and dirty ground possibly ruining the wearer's pants. The wearer of an oversized pair of pants can possibly avoid ruining the pants by tucking in the ends of the pants' legs into the wearer's footwear or folding the ends of the pants' legs so that they do not drag against the ground. However, such apparent resolutions are not acceptable because (1) the wearer may not be able to tuck in the pants' legs into the wearer's footwear because there's not enough room to do so and (2) folded pants legs eventually become unfolded as the wearer is walking requiring that the pants legs be folded again.

In many instances a relatively new pair of pants can be ruined because the pants' legs are frayed or ripped beyond repair. It is therefore desirable to provide some mechanism that prevents clothing such as pants from being damaged due to their portions being dragged along the ground as they are being worn.

SUMMARY OF THE INVENTION

The present invention provides a fastening system that allows a wearer of clothing and footwear to detachably fasten the wearer's clothing to the wearer's footwear to prevent at least a portion of such clothing from being dragged along the ground as the wearer is walking and to allow the wearer to maintain at least a portion of the clothing a certain distance above the ground while walking or standing. In particular, the fastening system of the present invention comprises an attachment member having a receiving surface where the receiving surface has attached thereto a first fastener. The fastening system of the present invention further comprises a fastening mechanism to which a second fastener is attached. The fastening mechanism is affixed to the wearer's clothing. The attachment member is detachably affixed to the wearer's footwear to allow the first and second fastener to be positioned with respect to each other so that they fasten to each other in detachable fashion. The first and second fasteners being so attached prevent at least a portion of the wearer's clothing from being dragged along the ground as the wearer is walking.

DETAILED DESCRIPTION

The present invention provides a fastening system that allows a wearer of clothing and footwear to detachably fasten the wearer's clothing to the wearer's footwear to prevent at least a portion of such clothing from being dragged along the ground as the wearer is walking and to allow the wearer to maintain at least a portion of the clothing a certain distance above the ground while walking or standing. In particular, the fastening system of the present invention comprises an attachment member having a receiving surface where the receiving surface has attached thereto a first fastener. The fastening system of the present invention further comprises a fastening mechanism to which a second fastener is attached. The fastening mechanism is affixed to the wearer's clothing. The attachment member is detachably affixed to the wearer's footwear to allow the first and second fastener to be positioned with respect to each other so that they fasten to each other in detachable fashion. The first and second fasteners being so attached prevent at least a portion of the wearer's clothing from being dragged along the ground as the wearer is walking.

Figure 1:
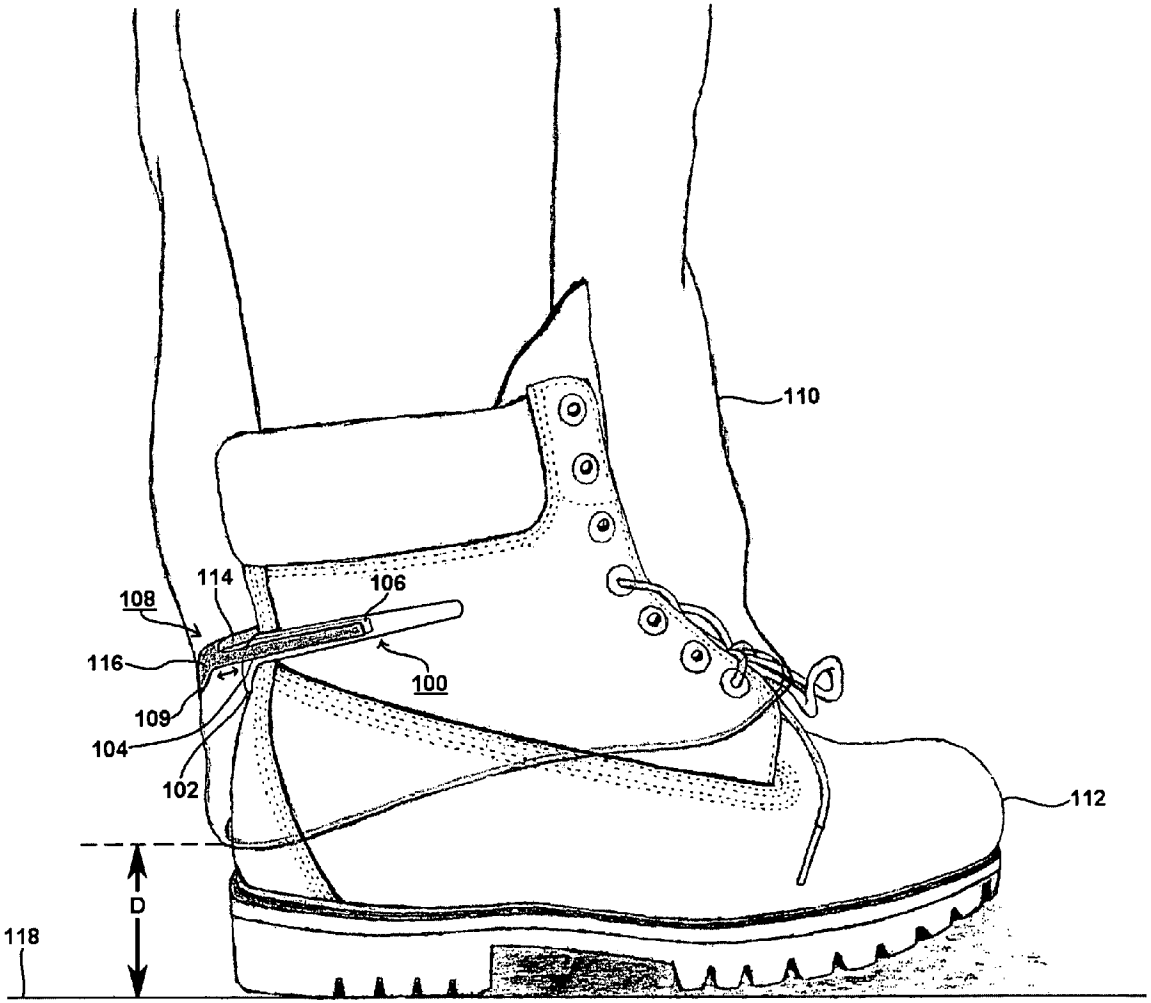
FIG. 1 is a side view of a portion of a person's leg wearing pants and footwear in which the clothes fastening system of the present invention is installed.

Referring to FIG. 1, there is shown a side view of the clothes fastening system of the present invention installed to a wearer of pants 110 and footwear 112. At the rear of footwear 112 attachment member 100 is detachably affixed to footwear 112 (shown as boots). It should be noted that the surface of pants 110 is shown as a see through depiction so as to allow one to view the clothes fastening system of the present invention when installed. Attachment member 100 has a downwardly extending portion 102 having a receiving surface 104 to which a first fastener 106 is permanently or detachably attached. Fastening mechanism 108 comprising material 109 and fastener 114 is attached to inner surface of pants 110 as shown. In particular, material 109 has outer surface 116 which is used to permanently or detachably attach fastening mechanism 108 to pants 110. Also, material 109 has inner surface 122 (not shown in FIG. 1; see FIG. 2A) to which a second fastener 114 is attached.

Figure 2B:
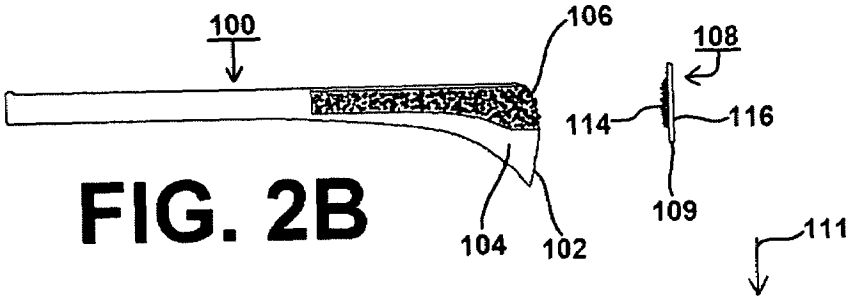
FIGS. 2A, 2B and 2C show top side and rear views of the attachment member and top and side views of the fastening mechanisms of the clothes fastening system of the present invention.
Figure 2C:
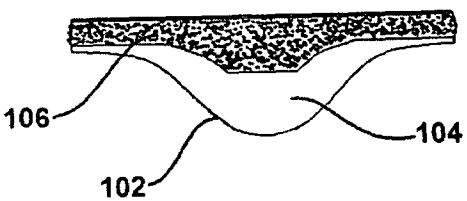
Figure 2A:
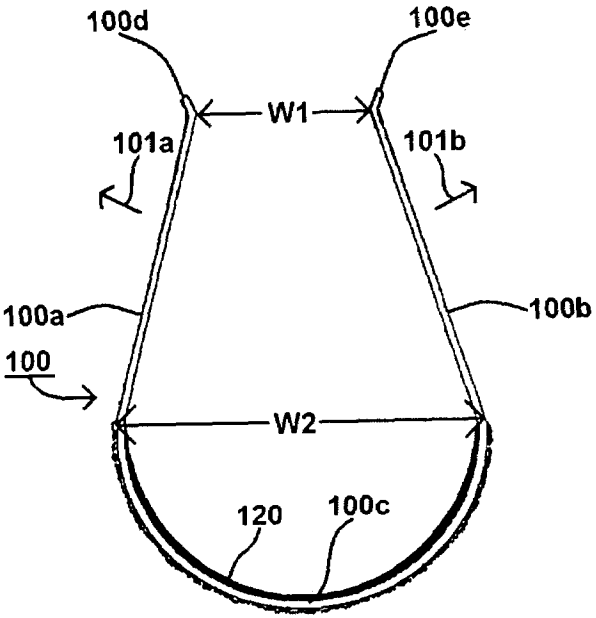
Figure 2A:
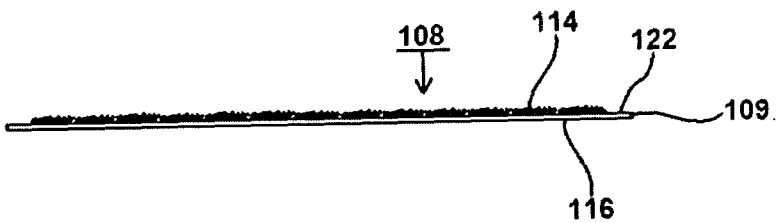

One embodiment of the fastening system of the present invention is to configure attachment member 100 as a U-shaped (see FIG. 2A) metallic spring preferably made from a rust resistant (e.g., stainless steel) alloy and/or metal. Attachment member 100 can also be made from a plastic material. Referring to FIGS. 2A, 2B and 2C there are shown top, side and rear views of attachment member 100 respectively. Attachment member 100 has arms 100*a* and 100*b* and bent portion 100*c*. Referring to FIG. 2A, arms 100*a* and 100*b* are constructed so that their respective end portions 100*d* and 100*e* are located a certain distance, $W_1$ from each other which distance is less that the width, $W_2$ of bent portion 100*c* thus forming a spring. For attachment member 100 to be detachably attached onto footwear 112, arms 100*a* and 100*b* are spread away from their initial position in the direction shown by arrows 101*a* and 101*b* respectively. With arms 100*a* and 100*b* spread, attachment member 100 is mounted onto footwear 112 so that bent portion 100*c* makes contact with the rear of the footwear (or is relatively closely positioned to the rear of footwear 112); the arms 100*a* and 100*b* are then released and allowed to spring back towards their initial positions grasping footwear 112. Fastening mechanism 108 comprises material 109 having inner surface 122 (see FIG. 2A) and outer surface 116. In a preferred embodiment, material 109 is a flexible material such as rubber. Second fastener 114 is attached to the inner surface 122 of material 109. Second fastener 114 can be permanently or detachably attached to inner surface 122 of material 109.

Referring to FIGS. 2B and 2C, the attachment member implemented as a U-shaped spring has a downwardly extending portion 102 having a receiving surface 104 on which first fastener 106 is attached. Material 109 of fastening mechanism 108 has an outer surface 116 which is attached to the inner surface of the wearer's pants 110 (not shown in FIG. 2). Material 109 is made of a flexible material (e.g., rubber) that can be sewn, glued, cemented or attached through any well known means onto the inner surface of the wearer's clothing. The detachable attachment of fastening mechanism 108 to the wearer's clothing can be achieved with well known detachable attachment arrangements such as VELCRO® strips, snap-attach buttons or reusable glue or cement. In FIGS. 2A-2C, the first and second fasteners are shown as mating VELCRO® attachments or strips. In FIG. 2A a material 120 of high coefficient of friction (e.g., rubber) is attached to the inner surface of bent portion 100*c* so that when the attachment member is installed onto a wearer's footwear, the attachment member will not tend to slide downward. It should be noted that downwardly extending portion 102 (as shown in FIG. 2B) is shown as curving inwards to further reduce the likelihood of the attachment member sliding downward (i.e., in the direction shown by arrow 111) once installed onto the wearer's footwear. The first and second fasteners are positioned on the wearer's footwear 112 and the wearer's clothing 110 respectively such that when they engage or when they fasten to each other they maintain at least a portion of the clothing 110 a certain distance D above the ground 118 (or above a platform on which the wearer is standing) preventing at least that portion of the clothing from being dragged against the ground or platform 118. The distance D is typically several inches or centimeters. It will be readily obvious to one of ordinary skill in the art to which this invention belongs that other well known fastening mechanisms can be used that allows a wearer to detachably attach the wearer's clothing 110 to the wearer's footwear 112. For example, a layer of reusable glue or cement solvent can be applied to the receiving surface 104 and to the inner surface 122 of material 109 where such glue or cement allows the surfaces 104 and 122 to detachably adhere to each other so as to affix clothing 110 to footwear 112; the reusable glue or cement is such that it can be used many times without losing its adhering capability.

Figure 3:
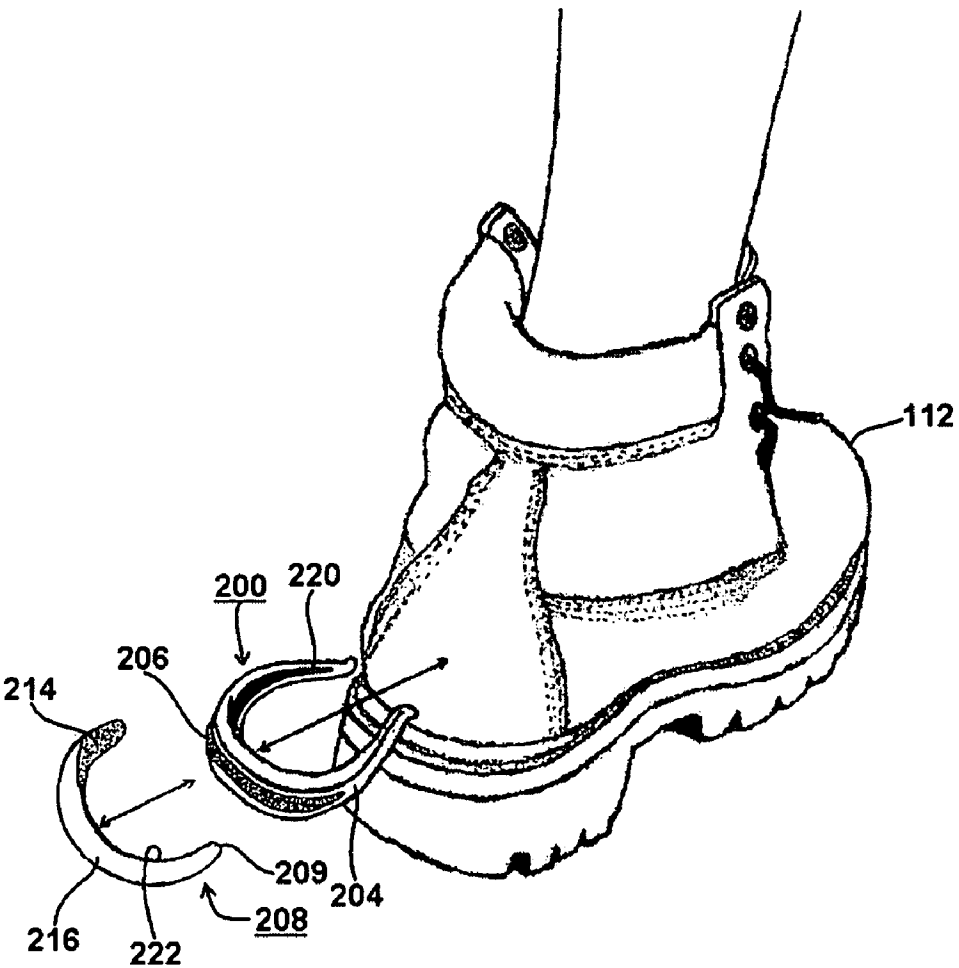
FIG. 3 shows an exploded perspective view of the clothes fastening system of the present invention.

Referring to FIG. 3 there is shown a perspective view of another embodiment of the clothes fastening system of the present invention. Attachment member 200 has first fastener 206 that is permanently or detachably attached to its outer surface 204. A material 220 of relatively high coefficient of friction (e.g., rubber) is attached to the inner surface of attachment member 200. A fastening mechanism 208 has a material 209 that has an outer surface 216 which is used to permanently or detachably attach fastening mechanism 208 to a wearer's clothing. Fastening mechanism 208 has an inner surface 222 to which second fastener 214 is permanently or detachably attached. Second fastener 214 is such that it mates, engages or fastens is detachable fashion to first fastener 206. Outer surface 216 of fastening mechanism 208 is adhered to a wearer's clothing with the use of well known adherence arrangements. First and second fasteners are again shown as VELCRO® strips.

Figure 4A:
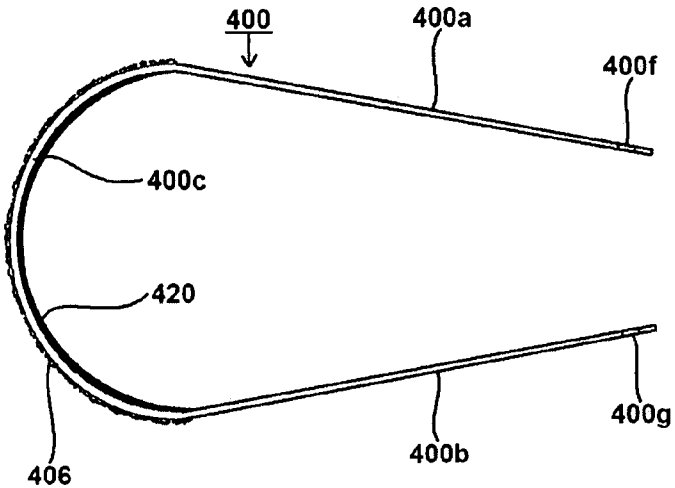
FIGS. 4A, 4B and 4C show top, rear and side views of another embodiment of the attachment member.
Figure 4B:
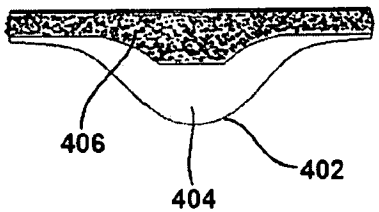
Figure 4C:
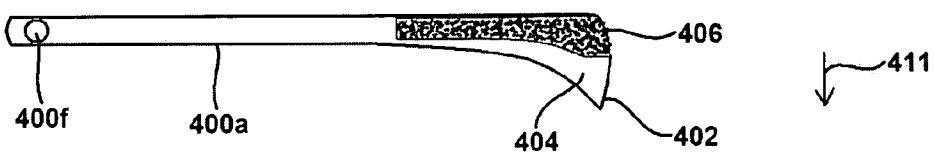

Referring to FIGS. 4A, 4B and 4C, there are shown top, rear and side views of another attachment member; i.e., attachment member 400. At the end of arms 400*a* and 400*b* are openings 400*f* and 400*g* respectively through which shoe laces or some other extended footwear member is passed to affix attachment member 400 to a wearer's footwear. As in FIG. 2, attachment member 400 has a first fastener 406 permanently or detachably attached to its outer surface 404. The attachment member 400 has a downwardly extending portion 402 which is curved inward to reduce the likelihood of the attachment member sliding downwards (downward direction shown by arrow 411) when installed onto a wearer's footwear. Also, a material 420 having a high coefficient of friction is attached to the inner surface of the bent portion 400*c* of attachment 400 similar to the manner material 120 is attached to bent portion 100*c* of attachment member. A fastening mechanism (not shown) similar in configuration to that shown in FIG. 2A is used with attachment member 400 to practice the clothes fastening system of the present invention.

Figure 5:
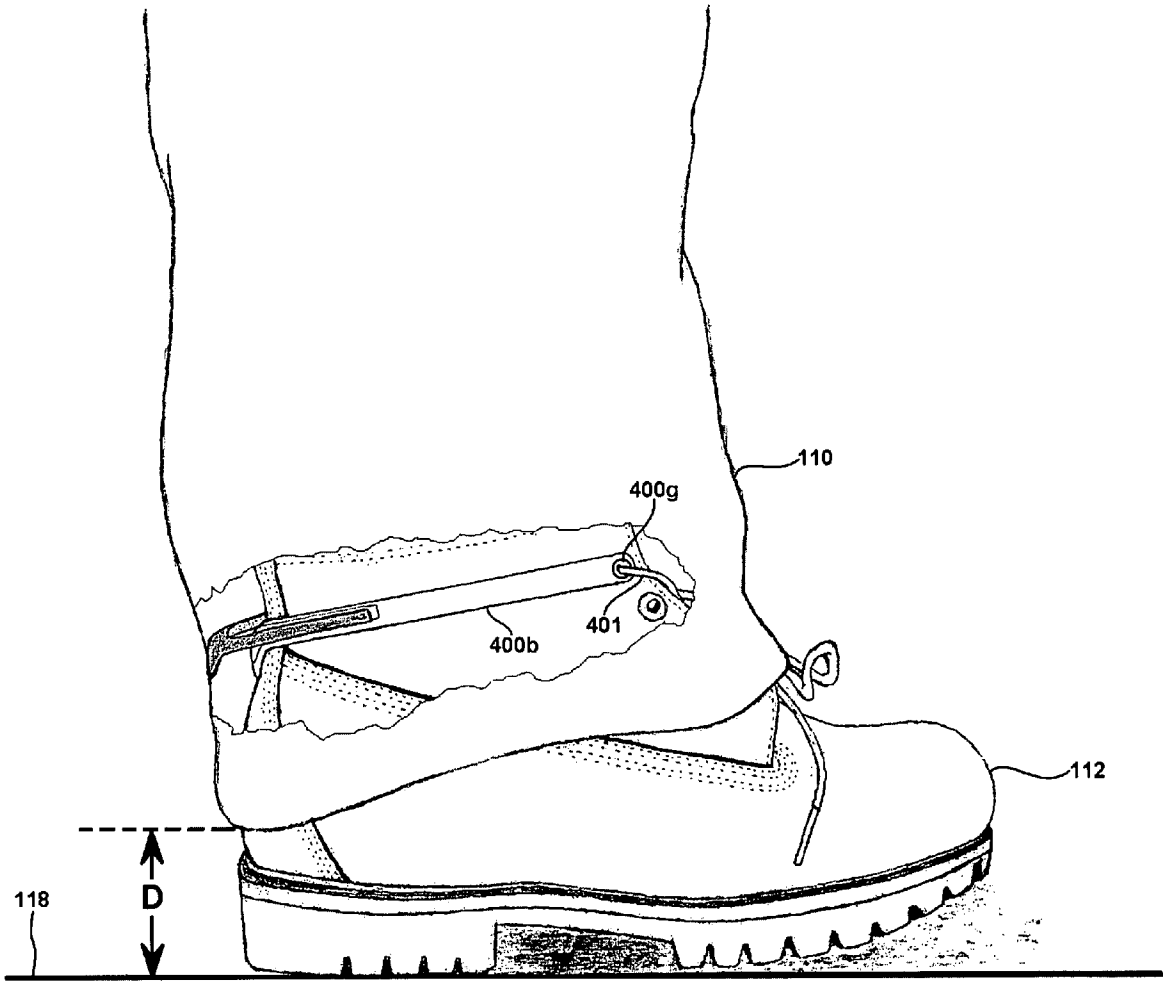
FIG. 5 shows a side view of a person's leg wearing pants and footwear in which the clothes fastening system of the present invention is installed using attachment member from FIGS. 4A, 4B and 4C.

Referring to FIG. 5, there is shown the manner in which attachment member 400 is attached to a wearer's footwear. Boot lace or shoe lace 401 is passed through the openings 400*f* (not shown) and 400*g*. It should be noted that opening 400*f* oppositely positioned at the other side of shoe 112 is not shown in FIG. 5.

Figure 6B:
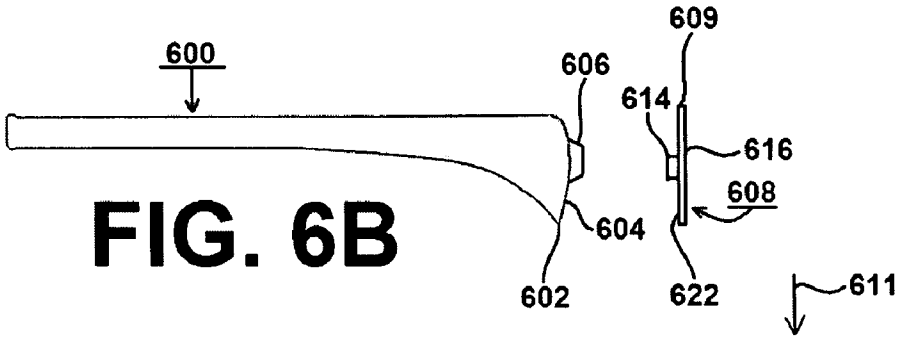
FIGS. 6A, 6B and 6C show top, side and rear views of yet another embodiment of the clothes fastening system of the present invention.
Figure 6C:
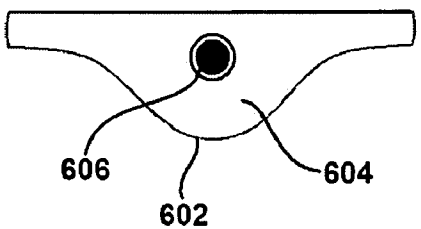
Figure 6A:
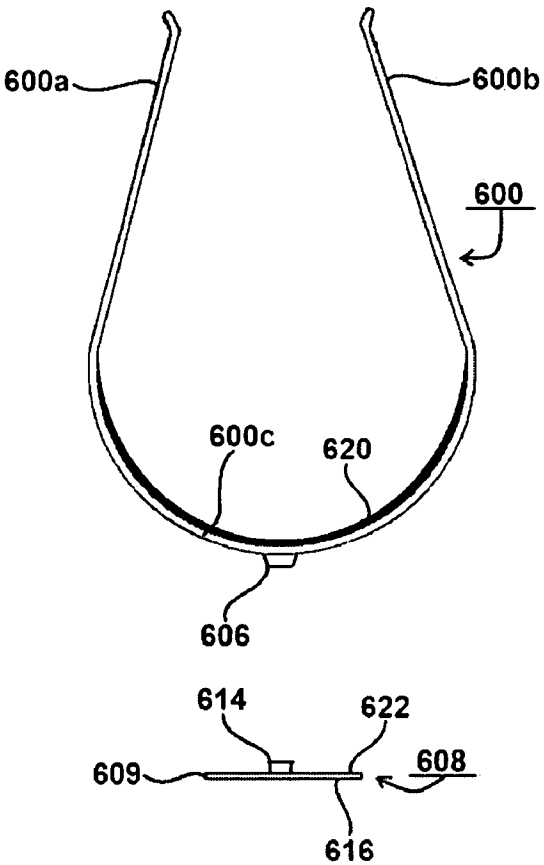

Referring to FIGS. 6A, 6B and 6C there is shown yet another embodiment of the clothes fastening system of the present invention where a snap-attach button arrangement is used to detachably attach a wearer's clothes to the wearer's footwear. Attachment member 600 in FIG. 6A is shown to have arms 600*a* and 600*b*, bent portion 600*c* and first fastener 606 which can be male or female portion of a snap-attach button. Fastening mechanism 608 comprises material 609 having outer surface 616 and inner surface 622 to which second fastener 614 is permanently or detachably attached. Fastening mechanism 608 can be permanently or detachably attached to a wearer's clothing via outer surface 616. Referring to FIG. 6B, first fastener 606 is permanently or detachably attached to surface 604 of downwardly extending portion 602 of attachment member 600. Downwardly extending portion 602 is curved inward to prevent the attachment member from sliding downward (direction shown by arrow 611) when the attachment member is attached to a wearer's footwear. Also, a material 620 of high coefficient of friction is attached to the inner surface of attachment member 600 to prevent the attachment member from sliding downward when attached to a wearer's footwear. FIG. 6C shows first fastener 606 as the female portion of the snap-attach button arrangement made from first fastener 606 and second fastener 614.

Figure 7B:
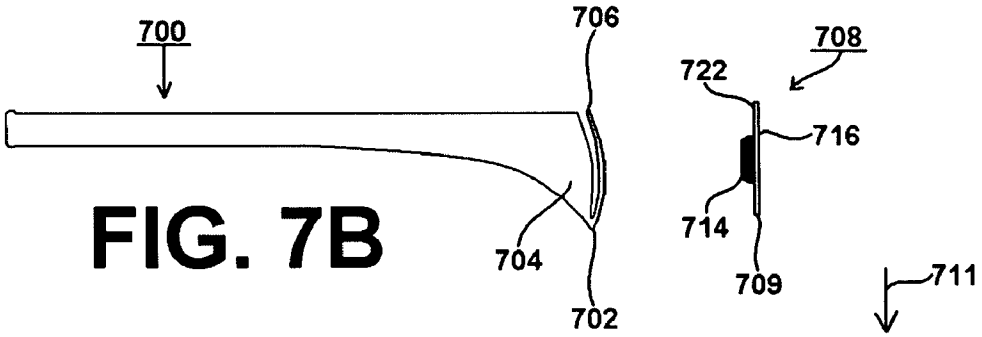
FIGS. 7A, 7B and 7C show top, side and rear views of still another embodiment of the clothes fastening system of the present invention.
Figure 7C:
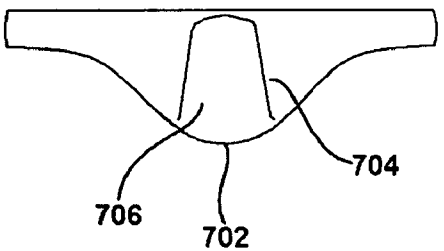
Figure 7A:
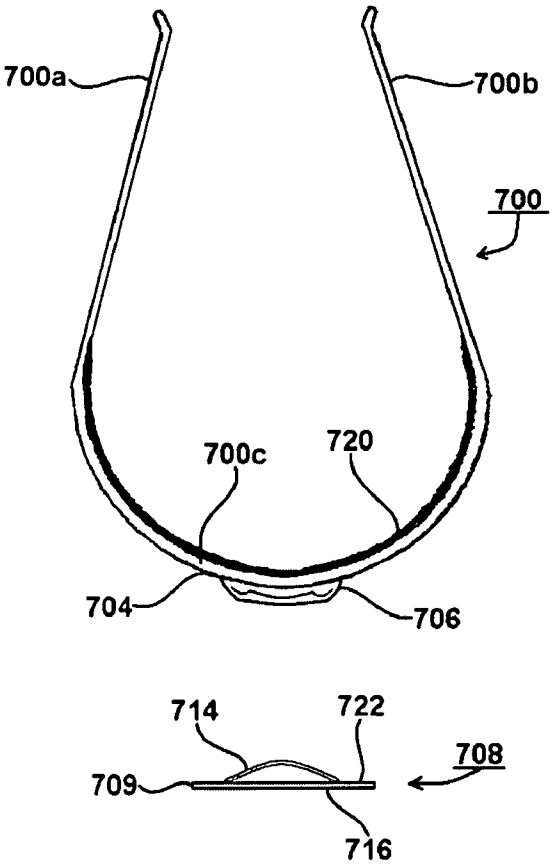

Referring to FIGS. 7A, 7B, 7C there is shown another embodiment of the clothes fastening system of the present invention where a strap and clip arrangement is used to detachably attach a wearer's clothes to the wearer's footwear. Attachment member 700 in FIG. 7A is shown to have arms 700*a* and 700*b*, bent portion 700*c* and first fastener 706 which is a clip that is integral with bent portion 700*c* and forms part of surface 704 (see FIG. 7B). Although not shown, clip 706 can be a separate clip component distinct from attachment member 700 but which can be permanently or detachably adhered to at least a portion of surface 704 of attachment member 700. Fastening mechanism 708 comprises material 709 having outer surface 716 and inner surface 722 to which second fastener 714 is permanently or detachably attached. Fastening mechanism 708 can be permanently or detachably attached to a wearer's clothing via outer surface 716. Referring to FIG. 7B, first fastener 706 is shown as being integral with surface 704 that forms at least part of downwardly extending portion 702 of attachment member 700. Downwardly extending portion 702 is curved inward to prevent the attachment member from sliding downward (direction shown by arrow 711) when the attachment member is attached to a wearer's footwear. Also, a material 720 of high coefficient of friction is attached to the inner surface of attachment member 700 to help prevent the attachment member from sliding downward when attached to a wearer's footwear. Also, material 720 can be made with an adhering substance so that attachment member 700 is permanently or detachably attached to the wearer's footwear. FIGS. 7B-7C show first fastener 706 and second fastener 714 respectively. The engagement of first fastener 706 and second fastener 714 is shown and explained in FIG. 8.

Figure 8:
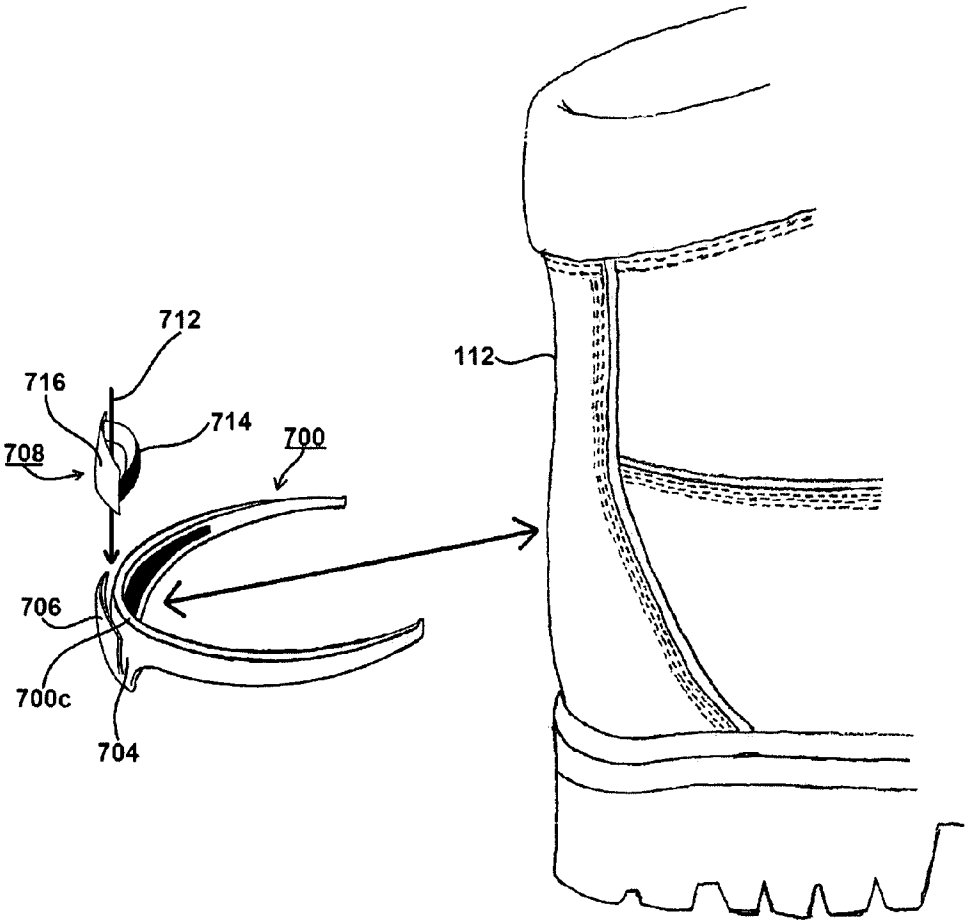
FIG. 8 shows an exploded perspective view of the clothes fastening system of the present invention using attachment member from FIGS. 7A, 7B and 7C and fastening mechanism from FIGS. 7A and 7B.

Referring to FIG. 8, there is shown a perspective view of attachment member 700 and fastening mechanism 708. Attachment member 700 has first fastener 706 that is permanently or detachably attached to its outer surface 704. Second fastener 714 is positioned such that it goes over first fastener 706 in the direction indicated by arrow 712; second fastener 714 thus engages first fastener 706 whereby the second fastener 714 is detachably or permanently secured between bent portion 700*c* of attachment member 700 and first fastener 706. Outer surface 716 of fastening mechanism 708 is adhered to a wearer's clothing with the use of well known adherence arrangements.

Figure 9C:
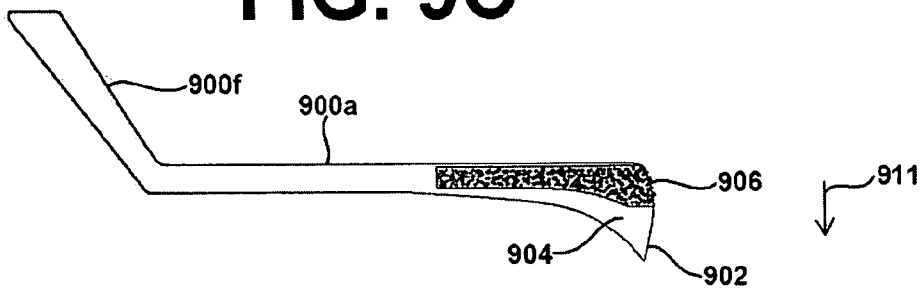
FIGS. 9A, 9B and 9C show top, side and rear views of a further embodiment of the attachment member.
Figure 9B:
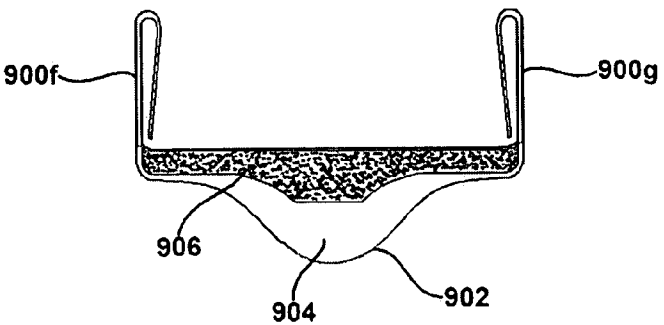
Figure 9A:
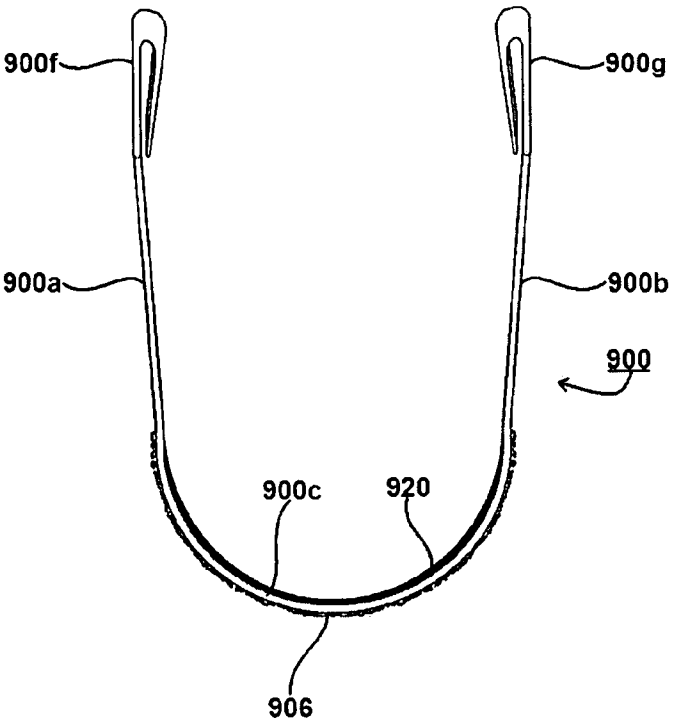

Referring to FIGS. 9A, 9B, 9C there are shown top, rear and side views respectively of another attachment member; i.e., attachment member 900. At the end of arms 900*a* and 900*b* are clips 900*f* and 900*g* respectively which are clipped onto the left and right side of a shoe cuff to affix attachment member 900 to a wearer's footwear. As shown in FIG. 9C the clips 900*f* and 900*g* are oriented at an angle with respect to arms 900*a* and 900*b* respectively and are integral to said arms. As in FIG. 2, attachment member 900 has a first fastener 906 permanently or detachably attached to its outer surface 904. The attachment member 900 has a downwardly extending portion 902 which is curved inward to reduce the likelihood of the attachment member sliding downwards (downward direction shown by arrow 911) when installed onto a wearer's footwear. Also, a material 920 having a high coefficient of friction is attached to the inner surface of the bent portion 900*c* of attachment member to help prevent attachment member 900 from sliding downward. Also, material 920 can be made with an adhering substance so that attachment member 900 is permanently or detachably attached to the wearer's footwear. A fastening mechanism (not shown) similar in configuration to that shown in FIG. 2A is used with attachment member 900 to practice the clothes fastening system of the present invention.

Figure 10:
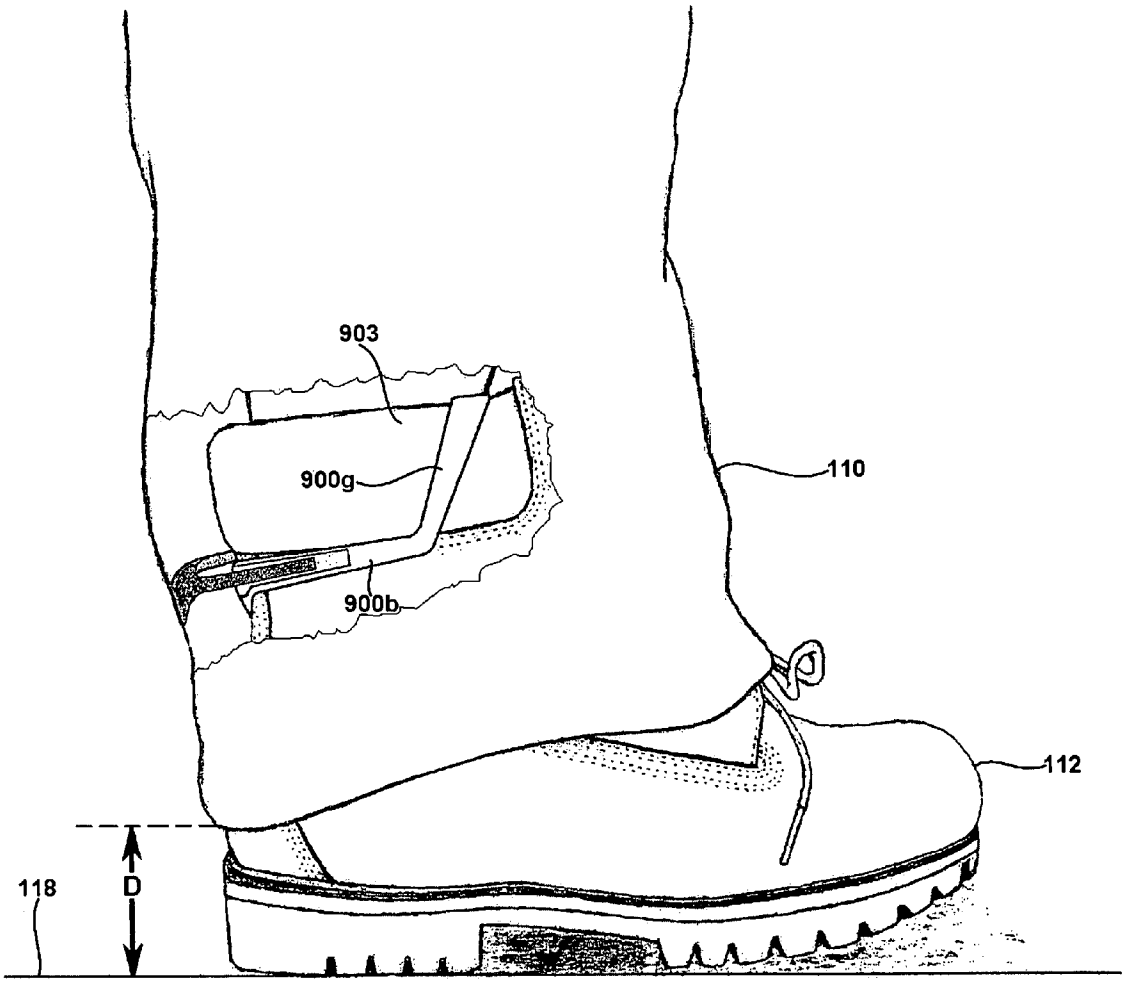
FIG. 10 shows a side view of a person's leg wearing pants and footwear in which the clothes fastening system of the present invention is installed using attachment member from FIGS. 9A, 9B and 9C.

Referring to FIG. 10, there is shown the manner in which attachment member 900 is attached to a wearer's footwear. Boot cuff or shoe cuff 903 (i.e., upper portion of boot 112) is clipped onto by clips 900*f* (not shown) and 900*g*. It should be noted that clip 900*f* is oppositely positioned with respect to clip 900*g* and clips onto an upper portion of boot 112 in substantially the same manner as clip 900*g*.

Figures 11A, 11B:
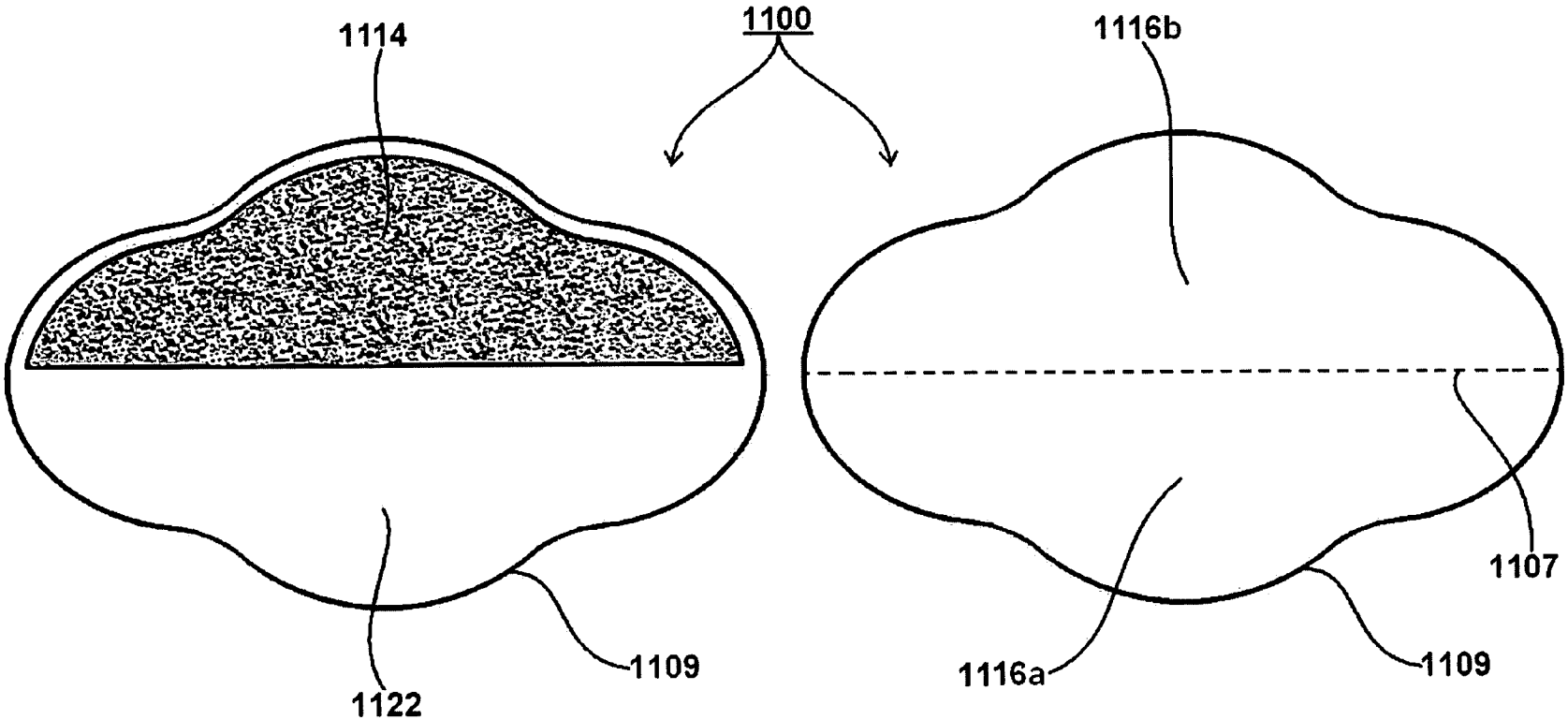
FIGS. 11A and 11B shows front and back views of still a further embodiment of the fastening mechanism.

Referring to FIGS. 11A, 11B there are shown front and back views respectively of another fastening mechanism; i.e., fastening mechanism 1100. Fastening mechanism 1100 comprises material 1109 having outer surface 1122 (see FIG. 11A). A portion of outer surface 1122 has second fastener 1114 (e.g., adhering substance) that is used to adhere permanently or detachably fastening mechanism 1100 to a wearer's footwear such as boot 112. Second fastener 1114 is permanently or detachably attached to outer surface 1122 of material 1109. Fastening mechanism has inner surfaces 1116*a* and 1116*b* as shown. In a preferred embodiment, material 1109 is a flexible material such as rubber or soft leather that can facilitate the folding of fastening mechanism 1100 across indentation line 1107 (see FIG. 11B) such that inner surfaces 1116*a* and 1116*b* mirror each other.

Figure 12:
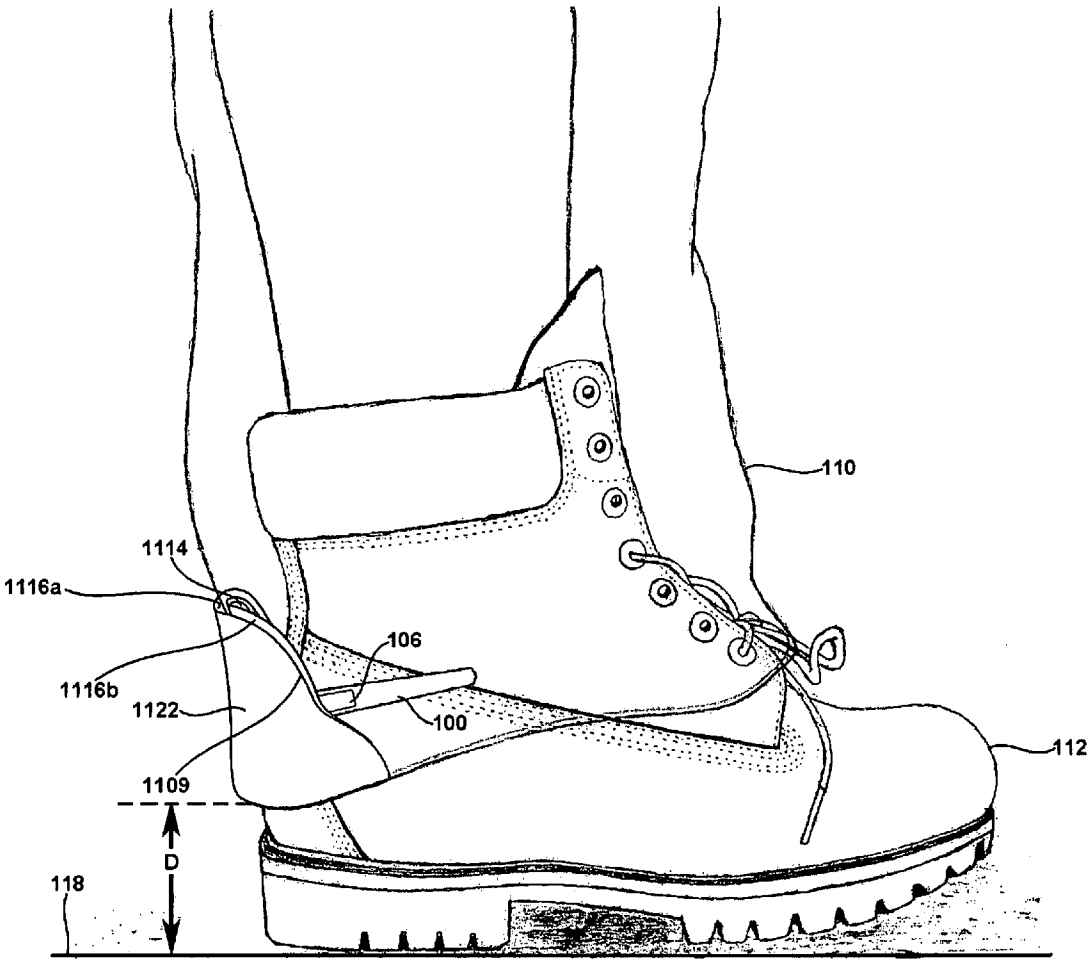
FIG. 12 is a side view of a portion of a person's leg wearing pants and footwear in which the clothes fastening system of the present invention is installed using fastening mechanism from FIGS. 11A and 11B.

Referring to FIG. 12, there is shown the manner in which fastening mechanism 1100 is attached to a wearer's pants. Fastening mechanism 1100 is folded such that outer surface 1122 is mounted on the outer surface of the wearer's pants 110 and second fastener 1114 is seen on the inner surface of the wearer's pants. Inner surfaces 1116*a* and 1116*b* are permanently or detachably attached to the heel of wearer's pants 110. The use of fastening mechanism 1100 aids in preventing any dirty liquids or substances from touching the heel surface of the wearer's pants 110.

Figure 13C:
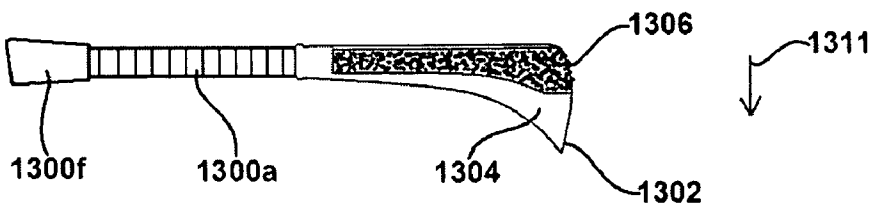
FIGS. 13A, 13B and 13C show top, side and rear views of yet another embodiment of the attachment member.
Figure 13B:
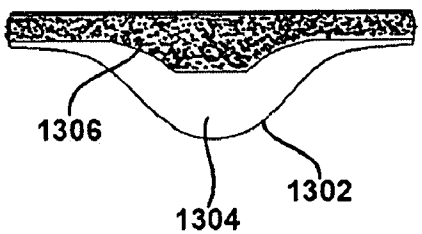
Figure 13A:
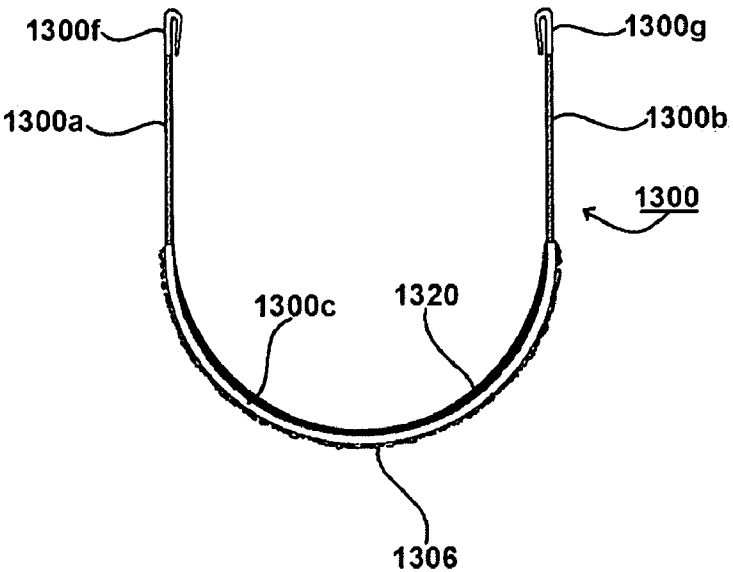
Figure 14:
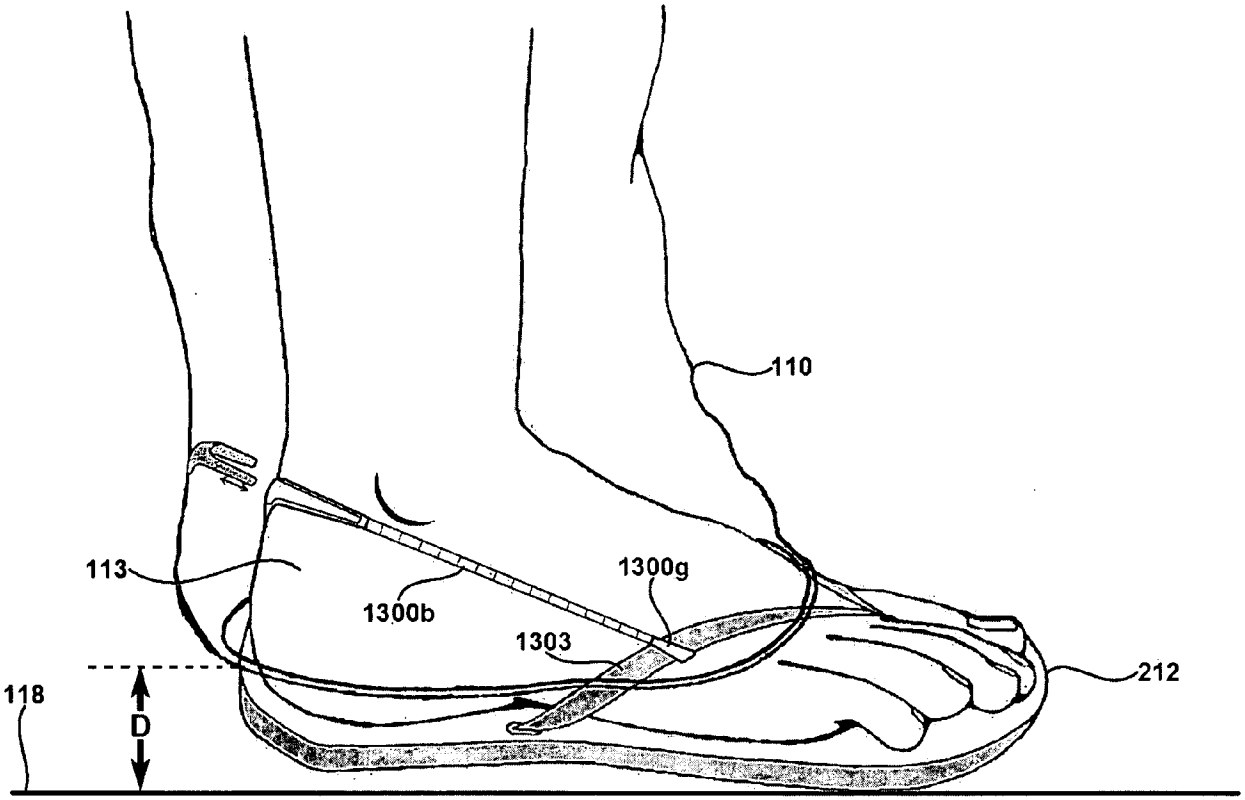
FIG. 14 is a side view of a portion of a person's leg wearing pants and footwear in which the clothes fastening system of the present invention is installed using attachment member from FIGS. 13A, 13B and 13C.

Referring to FIGS. 13A, 13B, 13C there are shown top, rear and side views of another attachment member; i.e., attachment member 1300. At the end of arms 1300*a* and 1300*b* are clips 1300*f* and 1300*g* respectively which are clipped onto the left and right side of a slipper strap to affix attachment member 1300 to a wearer's foot and footwear (see FIG. 14). Attachment member 1300 has a first fastener 1306 permanently or detachably attached to its outer surface 1304. The attachment member 1300 has a downwardly extending portion 1302 which is curved inward to reduce the likelihood of the attachment member sliding downwards (downward direction shown by arrow 1311) when installed onto a wearer's foot. Also, a material 1320 having a relatively high coefficient of friction is attached to the inner surface of the bent portion 1300*c* of attachment member. A fastening mechanism (not shown) similar in configuration to that shown in FIG. 2A is used with attachment member 1300 to practice the clothes fastening system of the present invention. It should be noted that bent portion 1300*c*, and clips 1300*f* and 1300*g* are preferably made from a soft polymer (e.g., plastic) material while arms 1300*a* and 1300*b* are preferably made from an elastic (e.g., rubber) material to allow such arms to stretch and have an elastic bias to allow attachment member 1300 to form a relatively tight fit with respect to the user's foot and footwear as shown in FIG. 14. Although not shown in FIG. 14, because of the elasticity and the sprig back force of the arms 1300*b* and 1300*a*, when the first fastener is detachably attached to the second fastener, a relatively tight fit of the user's clothing (e.g., pants 110) to the foot or footwear of the user is also formed.

Referring to FIG. 14, there is shown the manner in which attachment member 1300 is attached to a wearer's foot 113 and footwear 212. Footwear strap 1303 is clipped onto by clips 1300*f* (not shown) and 1300*g*. It should be noted that, although not shown, clip 1300*f* is oppositely positioned with respect to clip 1300*g* and attaches onto footwear 212 in substantially the same manner as clip 1300*g*.

Referring back to FIG. 7, although not shown, it would be obvious to a person having ordinary skill in the art to use attachment member 700 by it self. A portion of a person's clothing would therefore be caught in between the first fasteners 706 and receiving surface 704. The use of the attachment member would facilitate the purpose of keeping the clothing a certain distance above the ground.

It should be noted that FIGS. 1, 3 and 5 show one manner of how the attachment member and the fastening mechanism are positioned to allow the first and second fasteners to engage each other thus detachably attach the wearer's clothing to the wearer's footwear. Also, the attachment member can be used to hold a wearer's clothing against the wearer; in such a case, the attachment member is mounted on the wearer's foot even with a portion of the wearer's clothing trapped between the footwear and the attachment member.

It will be readily understood that various designs of the clothes fastening system of the present invention although not shown or discussed in detail fall within the scope of the claims of this invention. The clothes fastening system of the present invention comprises any system in which an attachment member is configured to attach to a wearer's footwear and has a first fastener so positioned so that when a second fastener is attached to a wearer's clothes the two fasteners engage each other in detachable fashion to prevent at least a portion of the wearer's clothes from dragging against the ground (or platform on which wearer is being supported or walking) as the wearer is walking. Although a boot and pants are shown as the footwear and clothing to which the clothes fastening system of the present invention is installed, the present invention is certainly not limited to such clothing and such footwear. For example, a full length woman's skirt along with tall boots or shoes can be used as the clothing and corresponding footwear to which the present invention can be installed. Examples of footwear are socks, stockings, panty hose, ski boots and sports shoes. Examples of clothing are skirts and overcoats. It will be appreciated that any type of clothing worn such that they are positioned in the vicinity of the wearer's footwear can be used to install the clothes fastening system of the present invention so that at least a portion of the clothing is prevented from dragging against the ground as the wearer is walking.

We claim:

1. A clothes fastening system comprising an attachment member comprising:

a bent portion;

a first arm extending from a first end of the bent portion;

a second arm extending from a second end of the bent portion;

a downwardly extending portion integral with the bent portion and extending from a point between the two ends with the bent portion having a receiving surface is integral with a first fastener where the attachment member is configured to springingly mount to a footwear of the wearer; and a fastening mechanism comprising a material having an outer surface and an inner surface to which a second fastener is attached where a surface of the fastening mechanism is affixed to a surface of a clothing external to the footwear of the wearer and the first fastener is detachably attachable to the second fastener.

2. The clothes fastening system of claim 1 where the first end has a clip.

3. The clothes fastening system of claim 1 where the second end has a clip.

4. The clothes fastening system of claim 1 where the first end has a clip and the second end has a clip.

5. The clothes fastening system of claim 1 where the outer surface of the fastening mechanism is affixed to a surface of a clothing external to the footwear of the wearer.

6. The clothes fastening system of claim 1 where the inner surface of the fastening mechanism is affixed to a surface of a clothing external to the footwear of the wearer.

* * * * *